US011229999B2

(12) United States Patent
Fairbrother

(10) Patent No.: US 11,229,999 B2
(45) Date of Patent: Jan. 25, 2022

(54) QUICK RELEASE TOOL HEAD STORAGE RACK

(71) Applicant: Kevin R. Fairbrother, Green Cove Springs, FL (US)

(72) Inventor: Kevin R. Fairbrother, Green Cove Springs, FL (US)

( * ) Notice: Subject to any disclaimer, the term of this patent is extended or adjusted under 35 U.S.C. 154(b) by 168 days.

(21) Appl. No.: 16/568,542

(22) Filed: Sep. 12, 2019

(65) Prior Publication Data

US 2020/0078930 A1 Mar. 12, 2020

Related U.S. Application Data

(60) Provisional application No. 62/730,117, filed on Sep. 12, 2018.

(51) Int. Cl.
*B25H 3/04* (2006.01)
*A47L 13/51* (2006.01)

(52) U.S. Cl.
CPC ..... *B25H 3/04* (2013.01); *A47L 13/51* (2013.01)

(58) Field of Classification Search
CPC .... A47F 7/0021; A47F 7/0028; A47F 7/0035; A47L 13/51; A47L 13/512; B25H 3/00; B25H 3/04
USPC ..... 211/60.1, 62, 63, 68, 70.1, 70.2, 70.6, 211/70.8; 248/49, 58, 62, 65, 68.1, 74.1, 248/110, 111, 113
See application file for complete search history.

(56) References Cited

U.S. PATENT DOCUMENTS 350,523 A * 10/1886 Bodley ..... A47K 1/09 211/65
824,149 A * 6/1906 Ruddell ..... A63D 15/10 211/68
1,050,519 A * 1/1913 Cox ..... A47G 25/12 211/62
1,222,844 A * 4/1917 Caldemeyer ..... A47F 7/0028 211/60.1
2,623,642 A * 12/1952 Looney ..... A47F 7/0028 211/65
2,661,920 A * 12/1953 Gochenour ..... A47L 13/512 248/113
2,904,188 A * 9/1959 Richardson ..... A47L 13/512 211/65
3,063,569 A * 11/1962 Huber ..... A47L 13/512 211/89.01
3,116,936 A * 1/1964 Magarian ..... A01D 67/00 280/47.19
3,298,531 A * 1/1967 Wilcke ..... A47L 13/512 211/70.6
3,468,508 A * 9/1969 Huver ..... A47B 81/005 248/314
3,537,595 A * 11/1970 Mathisen ..... A47F 7/0028 211/70.8

(Continued)

*Primary Examiner* — Joshua E Rodden
(74) *Attorney, Agent, or Firm* — William E. Noonan

(57) ABSTRACT

A storage rack for quick release tool heads includes a mounting bar that is secured to a wall or other supportive structure. The mounting bar carries a plurality of tubular mounting sleeves. Each sleeve has a connector hole for releasably interengaging a spring loaded connector button carried by a mounting post of a respective quick release tool head. The mounting post is inserted into a lower end of the mounting sleeve to releasably interengage the spring loaded button and corresponding mounting hole. This secures the tool head to the storage rack.

13 Claims, 4 Drawing Sheets

(56) References Cited

U.S. PATENT DOCUMENTS

| | | | | | |
|---|---|---|---|---|---|
| 3,759,538 | A * | 9/1973 | Fabiano | B62B 3/102 | 280/47.35 |
| 3,792,775 | A * | 2/1974 | Riddle | A01K 97/10 | 211/70.8 |
| 4,157,803 | A * | 6/1979 | Mack | A01K 97/10 | 211/70.8 |
| 4,286,717 | A * | 9/1981 | Liesinger | B25H 3/04 | 211/70.6 |
| 5,411,191 | A * | 5/1995 | Bunn, Jr. | A47F 7/0021 | 211/70.6 |
| 5,435,473 | A * | 7/1995 | Larkum | B60R 9/08 | 211/4 |
| 5,573,122 | A * | 11/1996 | Williams | A63B 55/40 | 211/70.2 |
| 5,730,302 | A * | 3/1998 | Groene | A45D 27/29 | 211/60.1 |
| 6,530,487 | B1 * | 3/2003 | Berry | B25H 3/04 | 211/60.1 |
| 7,156,242 | B2 * | 1/2007 | Lin | B25H 3/04 | 211/70.6 |
| 10,227,049 | B2 * | 3/2019 | Beznes | B60R 9/048 | |
| 2005/0145586 | A1 * | 7/2005 | Lin | A01B 1/00 | 211/70.6 |
| 2005/0184014 | A1 * | 8/2005 | Lin | B25H 3/04 | 211/70.6 |
| 2005/0269275 | A1 * | 12/2005 | Lin | B25H 3/04 | 211/70.6 |
| 2006/0226097 | A1 * | 10/2006 | Smith | B25H 3/04 | 211/70.6 |
| 2010/0108626 | A1 * | 5/2010 | Sorensen | B60R 7/08 | 211/70.8 |
| 2017/0210003 | A1 * | 7/2017 | Kopans | F16B 45/00 | |

* cited by examiner

QUICK RELEASE TOOL HEAD STORAGE RACK

RELATED APPLICATION

This application claims the benefit of U.S. Application Ser. No. 62/730,117 filed Sep. 12, 2018.

FIELD OF THE INVENTION

This invention relates to a tool storage rack and, more particularly, to a rack for storing and organizing quick release tool heads of the type used in cleaning tools and other implements.

BACKGROUND OF THE INVENTION

Some conventional tools employ a number of different tool heads that are selectively and interchangeably attached to the working end of an elongate pole or handle by means of a quick release connector mechanism. Typically, each tool head includes a cylindrical extension post that carries a spring loaded connector detent or button. A lower end of the handle supports a tubular sleeve with a connector hole formed transversely therethrough. The spring loaded connector button flexes and interengages the complementary connector hole when the tool head extension post is inserted into the sleeve of the handle. To change tool heads or to just remove an attached head, the user simply depresses the quick release connector button and slides the extension post out of the handle sleeve. Implements featuring quick release tool head mechanisms of this type are widely employed in both household and commercial cleaning tools such as wet and dry mops, brooms, brushes and squeegees. Cleaning tools featuring quick release mechanisms are especially popular for use in cleaning marine vessels (boats, yachts and jet skis), automobiles and recreational vehicles. Analogous tools can also be used in other implements; for example, for supporting assorted sizes of paint rollers at the end of a long pole. Other tools featuring interchangeable heads and elongate poles or handles include boat hooks, boat paddles, fish net adapters, fishing gaffs, scrubber pads and camera adapters.

Although many different types of tool storage racks are currently available, none is suitable for storing quick release tool heads of the type described above. Known racks and hangers do not provide means for holding the individual tool heads in a neatly separated and organized fashion that makes those items easy to identify and access as needed. Instead, the individual tool heads usually must be piled together in a closet, locker or storage bin. Often, the interchangeable heads are either stored randomly around a garage, vessel or other work area or not even put away at all between use. Accessories stored in this manner may not be readily and conveniently available for use and are apt to be damaged, misplaced and/or lost. In addition, tool heads that are not properly stowed and organized and are, instead, left lying about, can present a tripping hazard and a very messy appearance, particularly on a yacht or other marine vessel, or in a garage.

Conventional tool storage racks are likewise inadequate for holding quick release tool heads because they do not allow tool heads that have gotten wet to dry properly. In marine cleaning applications especially, accessories such as mop heads and brushes for cleaning decks and bulkheads can become wet during use. When one or more wet heads are simply piled together in a storage container, the drying time may be prolonged significantly.

Previous storage racks do not support such wet tool heads so that the heads hang and are spaced apart from one another in a manner that enables them to air dry as quickly and completely as possible. Wet tool heads that are not allowed to dry properly can create mold or mildew which presents a health hazard.

SUMMARY OF THE INVENTION

It is therefore an object of the present invention to provide a quick release tool head storage rack that supports a plurality of interchangeable quick release tool heads in a secure and organized fashion;

It is a further object of this invention to provide a quick release tool head storage rack that supports tool heads so that they are neatly stored, organized and displayed for ready and convenient access and use as needed;

It is a further object of this invention to provide a storage rack that reliably holds quick release tool heads between uses so that such implements are less likely to be misplaced or lost;

It is a further object of this invention to provide a rack for storing quick release tool heads in an aesthetically attractive manner and which greatly reduces the sloppy and messy appearance and the potential tripping hazard associated with known means of storing such items between uses;

It is a further object of this invention to provide a storage rack that is relatively inexpensive to manufacture and which may be assembled and installed quickly and conveniently on virtually any workplace wall or vertical surface;

It is a further object of this invention to provide a storage rack for quick release cleaning tools, such as cleaning implements employed in marine and automotive applications;

It is a further object of this invention to provide an extremely versatile storage rack for quick release tool heads that allows a wide variety of such heads to be stored at different heights and spacings relative to one another so that the individual tool heads may be quickly and conveniently identified and organized;

It is a further object of the present invention to provide a quick release tool head storage rack that supports wet heads in a manner that permits them to dry more quickly and effectively;

It is a further an object of the present invention to provide a quick release tool head storage rack that protects the stored tool heads from damage between uses.

It is a further object of this invention to provide a storage rack for virtually any type of quick release tool including, but not limited to, wet and dry mops, brooms, branches, squeegees and paint rollers.

This invention features a storage rack for holding and organizing one or more quick release tool heads, each head including a cylindrical extension post that carries a spring loaded button connector for releasably interengaging a corresponding quick release connector hole of an elongate tool handle. The rack includes a supportive mounting bar. At least one tubular mounting sleeve is attached to and suspended from the bar. Each sleeve includes an open lower end that communicates with an interior channel of the tubular mounting sleeve. The sleeve further includes at least one connector hole formed transversely through the tubular sleeve in communication with the interior channel of the sleeve. The extension post of a respective tool head is inserted into the channel of the mounting sleeve such that the sleeve engages and depresses the spring loaded button carried by the extension post and the connector button engages the connector hole in the sleeve to secure the tool head to the sleeve. As a result, the tool head is engaged with and hung from the storage rack.

In a preferred embodiment, the mounting bar may be attached to and extend substantially horizontally across a substantially vertical wall or other structure. The mounting bar may have a substantially flat, linear shape or configuration. In alternative embodiments, the bar may include a convex shape or other configuration. The bar also may include a pair of arms at respective ends thereof. The arms may be unitarily joined to and extend generally perpendicularly rearwardly from the bar. Each arm may carry a unitary tab formed substantially perpendicularly to the arm for engaging a supportive wall or other vertical surface. Each of the tabs employed by the rack may include a fastener hole for receiving a screw or other fastener to more securely join the mounting bar and overall storage rack to a wall or other supportive surface.

At least one support bracket may be attached to the mounting bar between the arms. The support bracket may include upper and lower tabs formed unitarily at respective ends of the support bracket for interengaging and attaching to the mounting bar and the vertical supportive surface, respectively. An angled bracket segment may extend between the upper and lower tabs.

At least one retaining clip may be carried by the mounting bar for holding an elongate quick release tool handle. At least one clip may be mounted to a respective support arm and/or to an intermediate portion of the bar between the elongate support arms.

This invention also features a storage rack for holding and organizing one or more quick release tool heads above an underlying surface wherein each tool head includes an extension that carries a quick release connector for releasably interengaging a complementary quick release connector of an elongate tool handle. The rack includes a support and at least one mounting component carried by the support above the underlying surface and including a quick release connector substantially identical to the quick release connector of the tool handle. The mounting component is interengageable by a respective tool head such that the quick release connector of the mounting component releasably interengages the quick release connector of the tool head to secure to the tool head to the mounting component.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
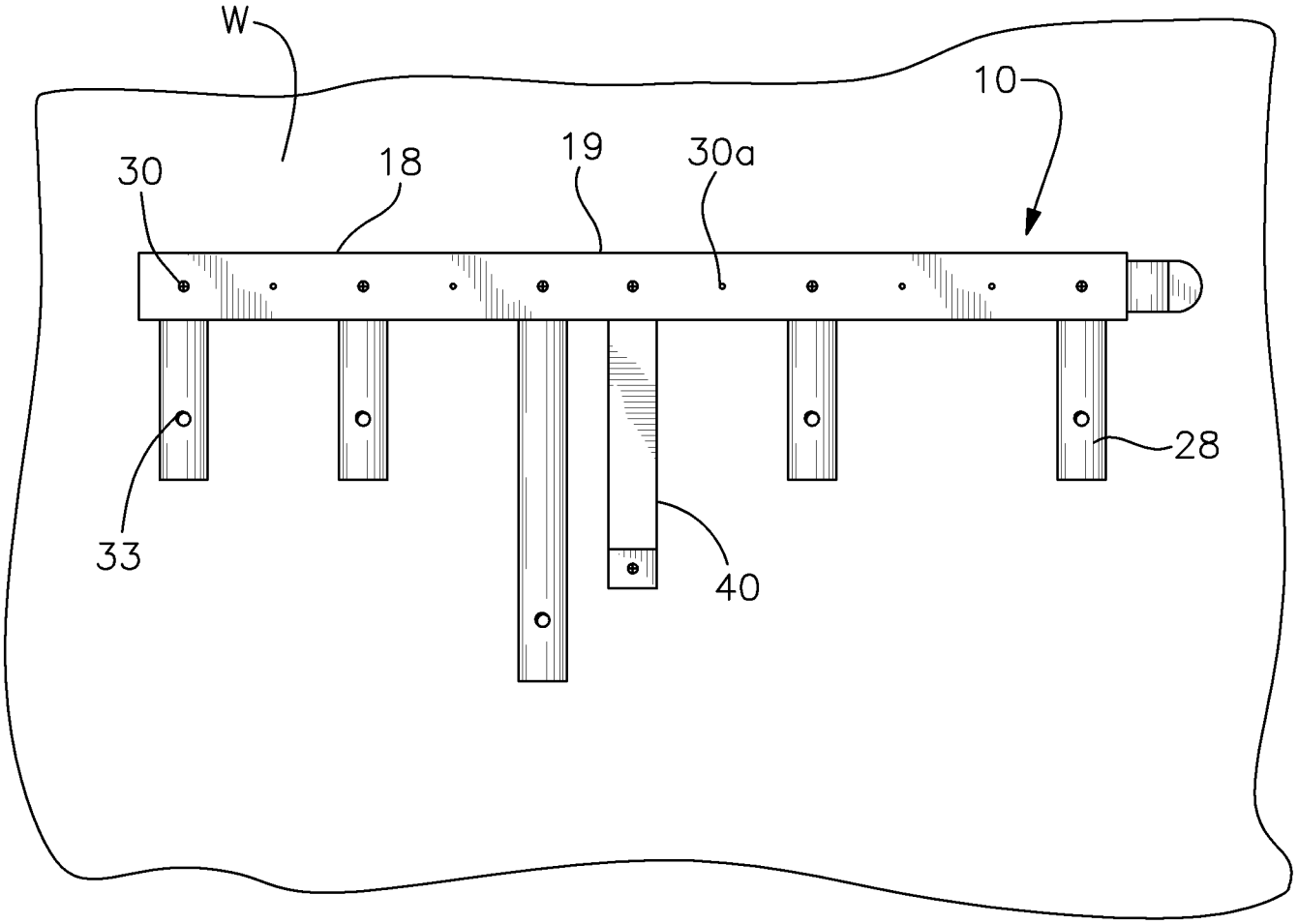
FIG. 1 is an elevational front view of a preferred storage rack in accordance with this invention.
Figure 2:
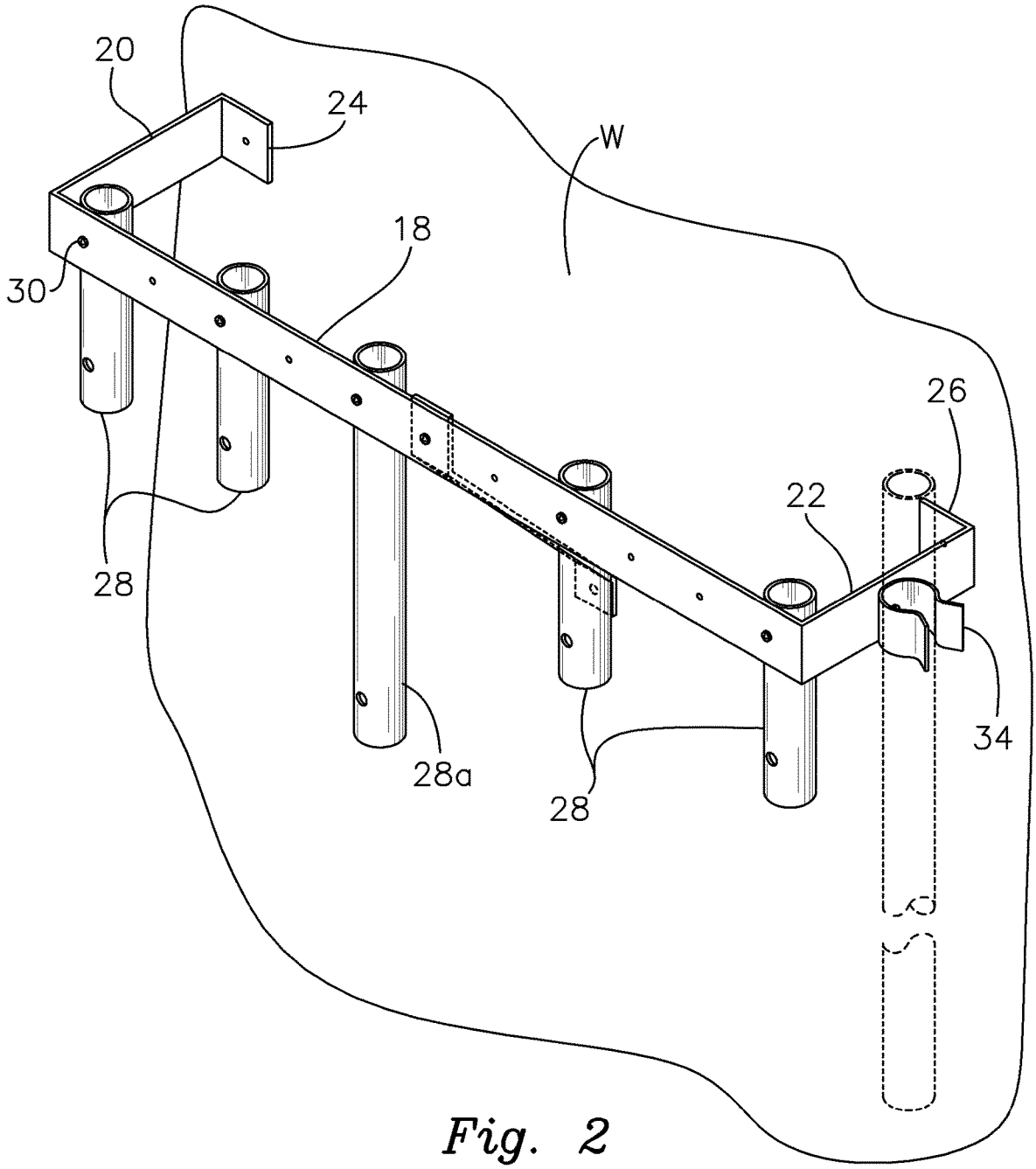
FIG. 2 is a top perspective view of the storage rack of FIG. 1.
Figure 3:
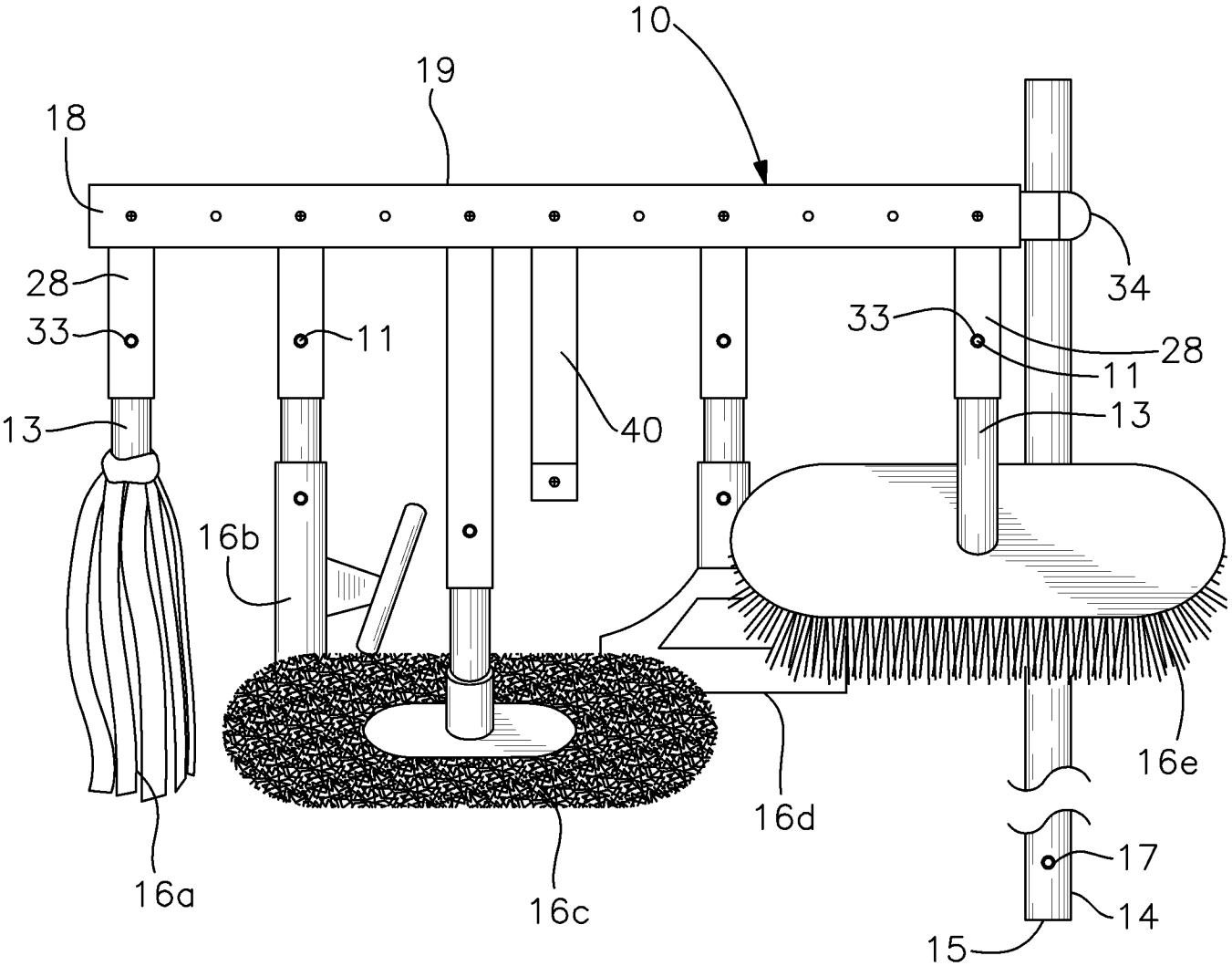
FIG. 3 is a front elevational view of the storage rack of FIGS. 1 and 2 with the handle and interengageable tool handle of a quick release tool supported thereon.
Figure 4:
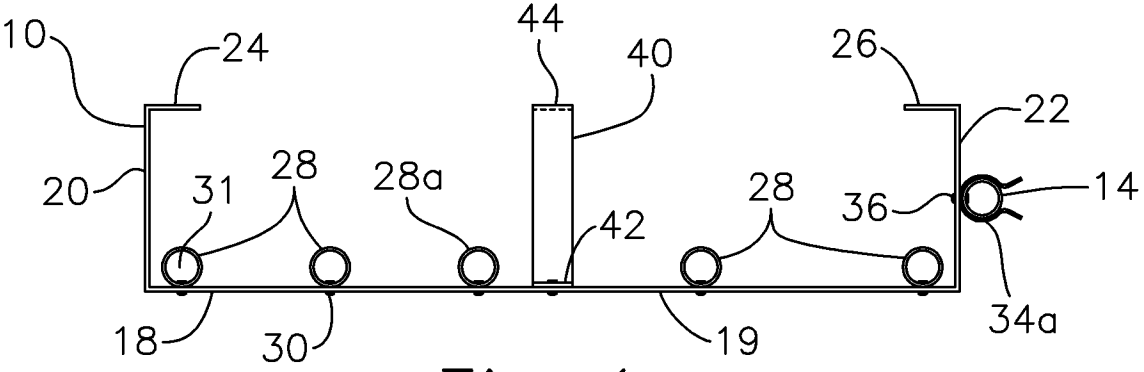
FIG. 4 is a top plan view of a slightly different version of the storage rack.
Figure 5:
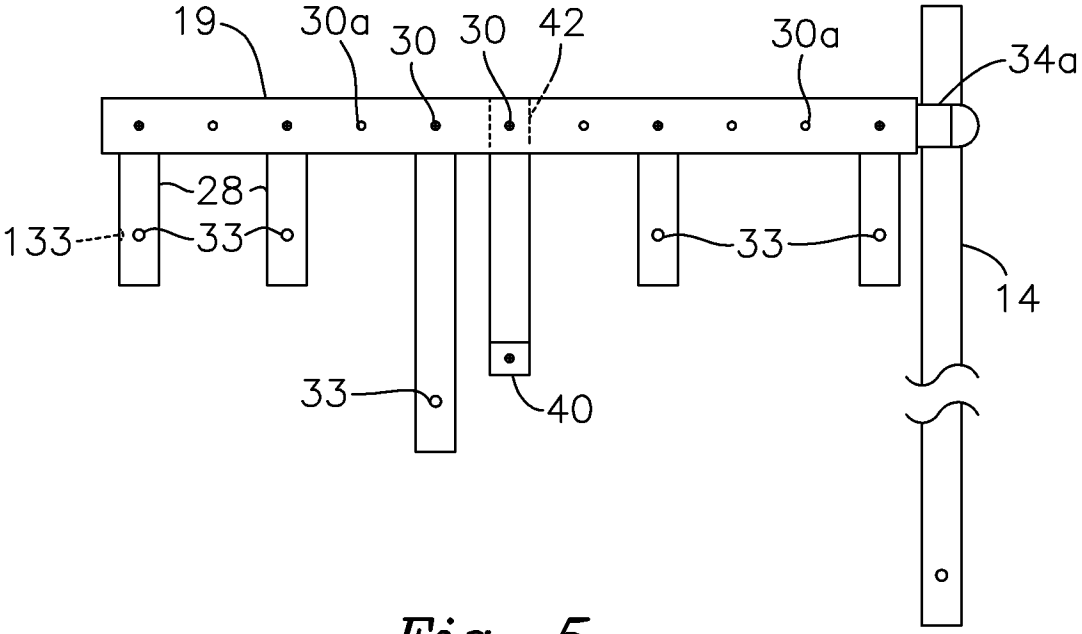
FIG. 5 is front elevational view of the embodiment of FIG. 4.
Figure 6:
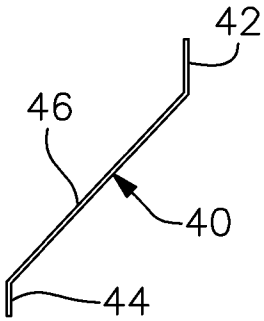
FIG. 6 is a side elevational view of the support bracket.

There is shown in FIGS. 1-5 a storage rack 10 for holding a conventional quick release cleaning tool assembly (shown in FIG. 3 only). The tool assembly includes an elongate tubular handle 14 (which may be, but is not necessarily a telescoping handle) and a plurality of interchangeable tool heads, which in the disclosed embodiment, include a chamois 16*a*, a boat hook 16*b*, a scrubber pad 16*c*, a squeegee handle 16*d* and a brush 16*e*. As is known in the prior art, tool heads 16*a*-16*e* are releasably and interchangeably attached to the lower, working end of elongate handle 14 as needed for performing respective tasks. This is accomplished by depressing the conventional spring loaded connector button 11 on a selected one of the tool heads and inserting the extension stub or post 13 of the tool head into the open lower end 15 of handle 14 until the spring loaded button or detent 11 interengages and snaps into the standard connector hole 17 in the handle. This releasably locks the selected tool head onto the handle so that the quick release tool is assembled and ready for use. Again, the foregoing structure and operation are conventional and will be understood to persons skilled in the art. As used herein "button" should be understood to encompass any and all types of spring loaded buttons, detents, latches, and other connectors that are conventionally used to secure a quick release tool head to an associated handle.

The present invention allows all of the individual tool heads and accessories that are available for attachment to the quick release tool handle to be quickly and conveniently stored and organized along with handle 14. It should be understood that various alternative types of interchangeable tool heads and accessories may be stored and organized on rack 10 in accordance with this invention. The particular types of quick release tool mechanisms and tool heads that may be stored will be understood to persons skilled in the art and do not constitute a limitation on this invention.

As further shown in FIGS. 1-5, rack 10 includes a support comprising an elongate and generally flat mounting bar 18 that is oriented generally horizontally for mounting to a supportive wall or other generally vertical surface W (FIGS. 1-3). A preferred means for attaching bar 18 to wall W is described more fully below. Bar 18 is typically composed of a durable metal or metal alloy. Plastics and other durable materials may also be employed. In the version shown in FIGS. 3 and 4, the metal bar has a length of 16", although this dimension, as well as the other dimensions shown in FIGS. 4 and 5 may be varied within the scope of this invention. Proximate each end of bar 18, the bar bends perpendicularly and extends rearwardly to form respective arms 20 and 22, which are preferably formed unitarily with a flat intermediate segment 19 of bar 18. Each arm has a length of 4.5", which provides the spacing between bar 18 and the wall to which the rack is mounted. The distal ends of arms 20, 22 are themselves bent unitarily inwardly at 90° to form 1" mounting tabs 24 and 26. Tabs 24 and 26 flushly engage wall W and include respective mounting holes through which screws or comparable fasteners are installed to attach bar 18 to wall W.

Rack 10 is further supported by employing a metal support bracket 40, which interconnects intermediate segment 19 of bar 18 and supportive wall W as best shown in FIGS. 1 and 3. In particular, as illustrated in FIG. 8, support bracket 40 includes unitary upper and lower tabs 42 and 44 respectively. Upper tab 42 is attached to an inner surface of mounting bar segment 19 by a connector 30. Lower tab 44 is similarly joined to the wall W. Inclined intermediate segment 46 interconnects tabs 42 and 44 and provides for improved strength and support so that the rack remains securely mounted to the wall or other vertical surface.

It should be understood that in alternative embodiments, bracket 10 may be mounted to a wall or substantially vertical surface in various other ways and using other means of structural support. For example, in marine applications, mounting bar 18 may be secured to a boat railing or other marine structure with hose clamps.

Rack 10 further includes a plurality of tubular mounting sleeves 28, which are attached to and depend from a forward longitudinal segment 19 of bar 18. In the embodiment disclosed herein, four cylindrical mounting sleeves having lengths of 3.5" apiece are disclosed. In addition, an extended mounting sleeve 28*a* is secured centrally along bar segment 19. This central sleeve has a length of 7", which allows supported tool heads to be hung in a vertically staggered arrangement from the rack, as will be described more fully below. Each mounting sleeve 28, 28*a* is secured to the inside surface of bar segment 19 by a respective machine bolt and nut or other fastener 30 engaged through corresponding holes in bar segment 19 and the sleeve. Each tubular sleeve 28, 28*a* includes an interior diameter of ¾" or other diameter which allows the mounting post of a respective tool head to be slidably inserted into the sleeve in accordance with this invention. Although five cylindrical sleeves are depicted as being attached to the mounting bar 18 in the embodiments disclosed herein, in alternative embodiments, other numbers of tubular sleeves 28, 28*a* and sleeves having various other lengths and diameters may be secured to and suspended from mounting bar 18. A plurality of additional mounting holes 30*a* are formed in segment 19 of mounting bar 18. This allows mounting sleeves 28, 28*a* to be conveniently repositioned along bar 18, as needed, in order to accommodate particular sizes, shapes and numbers of tool heads. Tubular mounting sleeves may also be added along or deleted from the mounting bar as needed to support a selected number of tool heads.

Each of mounting sleeves 28, 28*a* includes an open bottom end that communicates with the interior bore 31 of the sleeve. See FIG. 4. Each sleeve also includes a respective connector hole 33 (FIG. 5) which is formed transversely through the sleeve proximate its lower end and which communicates with interior channel 31. One or more of the sleeves 28, 28*a* may also include a connector hole formed at or about 90° on the sleeve to connector hole 33. See also FIG. 5 and the related description below. These mounting holes allow the respective tool heads to be attached to the mounting sleeves in the manner described more fully below. Alternative numbers, arrangements and radial orientations of mounting holes may be formed in one or more of the sleeves within the scope of this invention.

One or more handle mounting clips may also be attached to the horizontal mounting bar 18. In particular, as shown in the version in FIGS. 1-3, a mounting clip 34 may be secured to one of the side arms 22 of bar 18. Clip 34 comprises a spring clip with a pair of separated arms that may be resiliently spread to receive and hold handle 14 as best depicted in FIG. 3. Clip 34 is attached to arm 22 by an appropriate screw or other type of connector. In alternative embodiments, clip 34 may be attached to arm 20 or a respective clip may be attached to each of arms 20 and 22. In still other embodiments, a similar clip, not shown, may be attached to forward intermediate segment 19 of mounting bar 18 by a screw engaged through one of the previously described mounting holes formed in segment 19 of bar 18.

In operation, storage rack 10 is installed on a wall, vertical surface or other underlying surface in the manner previously described. The rack is generally oriented so that bar 18 is horizontal and the mounting sleeves 28, 28*a* extend axially vertically, with the mounting holes 33 proximate the lower ends of the mounting sleeves. Various tool heads or accessories 16*a*-16*e* can then be neatly, conveniently and accessibly stored and organized on the installed rack as shown in FIG. 3. In particular, the standard mounting extension stub or post 13 of each head is aligned with and inserted into the open bottom end of a respective mounting sleeve 28, 28*a*. Brush head 16*e* is illustrated at this stage, with its post 13 only partially inserted into a respective sleeve 28 and its button connector 11 positioned below sleeve 33. The spring loaded button connector 11 on each post 13 is then depressed in a known manner and the post 13 is slid fully into its respective mounting sleeve 28, 28*a*. The spring loaded button remains depressed until it reaches and engages the corresponding connector hole 33 in the sleeve. The depressed button 11 then springs open and interengages/fits into hole 33. This releasably locks each tool head into a respective mounting sleeve 28, 28*a*. The tool heads are thereby secured to and suspended from the rack in the organized manner shown by fully attached tool heads 16*a*-16*d* in FIG. 3. Button 11 of brush head 13 is likewise fully inserted into and interengaged with the connector hole 33 of its corresponding mounting sleeve 28.

In the above described condition, the individual tool heads are reliably stored and conveniently organized. Each tool head is clearly visible and is easily accessed when needed. Unlike the prior art, the tool heads are not jumbled or piled together in a closet or container and do not have to be tediously sorted, separated and identified as needed. Because the individual tool heads and accessories are visibly presented in an attractive and organized fashion, the tools are much less apt to be misplaced or lost. In addition, the tool heads are not stored randomly and haphazardly or left tying around a boat dock, work place or garage floor, etc. Instead, they are supported and suspended safely above the underlying surface and are protected from damage.

The multiple positioning holes 30*a* formed along the length of mounting bar 18 provide the user with beneficial versatility. The supportive sleeves may be repositioned, added and removed as needed so that various shapes, sizes and numbers of tool heads and accessories may be accommodated by rack 10. The rack employs relatively inexpensive and easy to obtain metal pieces and parts. This facilitates manufacture and reduces manufacturing costs considerably. As shown in FIG. 3, the supported tool heads are stored in a neat and very organized manner. Because the tool heads are not stored in a container they are much more conveniently and immediately accessible to the user. The rack also presents and displays the tool heads in an aesthetically attractive manner. Tool heads not being used are not strewn or piled around a deck or workspace floor. As a result, they do not present a tripping hazard. In addition, the individual tool heads are suspended from the rack in a separated manner with the heads pointing down. This allows wet accessories (mop heads, brush heads) to dry more quickly and effectively.

In certain versions of this invention, the tool head supporting sleeves 28, 28*a* may include a second connector hole for engaging a tool head at an alternative angle relative to the sleeve. For example, in FIG. 5, each sleeve includes a mounting hole 33 as previously described. As shown in the left-hand tubular sleeve, an optional second connecting hole 133, shown in phantom, may be formed at 90° to hole 33. The spring loaded connector button of the tool head may be interengaged with connector hole 133 in a manner analogous to that previously described. This allows a supported tool head to be oriented at multiple angles within its supportive sleeve 128. Various other orientations and numbers of such mounting holes may be formed in one or more of in the supportive sleeves in accordance with this invention.

The mounting bar may be constructed in various other ways and feature alternative shapes (e.g. convex, concave, curved etc) within the scope of this invention. Other components and fasteners may be utilized to attach or secure the bar to a wall or other supportive structure. In alternative embodiments, the mounting sleeves may be secured to and oriented substantially vertically from other types of support structures, which hold the mounting sleeve above a floor or other underlying surface. Each mounting sleeve should be supported at a height that holds the lower end of a supported tool head sufficiently above an underlying floor or deck surface so that the tool heads do not engage the underlying surface and are allowed to dry more quickly and completely.

In still other versions of this invention, the rack may be employed for holding and organizing tool heads of quick release tools wherein the spring loaded quick release button, detent or other connector is contained in the tool handle and each tool head includes a complementary connector hole that is releasably interengaged by the spring loaded button connector. In such cases, the rack may again employ a generally tubular mounting sleeve or an alternative non-tubular mounting component, which includes a spring loaded quick release button connector constructed in a manner that will be understood to persons skilled in the art. As in the previously described embodiment, this quick release connector will be substantially identical or equivalent to the spring loaded quick release connector employed in the elongate handle used for such quick release tools. Otherwise, the construction of such alternative racks will be identical or at least similar and analogous to the construction of the previously described embodiment. Corresponding benefits and advantages will be provided by either version.

The storage rack is also effective for storing and organizing quick release tools other than those used for cleaning purposes. For example, quick release tools employed in painting, gardening and other applications may be effectively and safely stored in a more organized and aesthetically attractive fashion using the storage rack of this invention.

From the foregoing it may be seen that the apparatus of this invention provides for to a storage rack for a quick release tool head of the type employed in cleaning and other applications. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A storage rack for holding and organizing one or more quick release tool heads, each tool head including an extension post that carries a spring loaded button connector for releasably interengaging a complementary quick release connector hole of an elongate tool handle, said rack comprising:

a support; and at least one mounting sleeve carried by said support having an open lower end and an interior channel in communication with said open lower end, said mounting sleeve further including at least one connector hole formed transversely through said mounting sleeve in communication with said interior channel; said interior channel of said mounting sleeve for receiving the extension post of a respective tool head such that said mounting sleeve depresses the spring loaded button carried by the extension post and the connector button interengages said connector hole in said sleeve to secure the tool head to said mounting sleeve; said support including a generally horizontal mounting bar and said interior channel of each said mounting sleeve including a longitudinal axis, each mounting sleeve being connected to said mounting bar such that a longitudinal axis of said interior channel of said mounting sleeve is oriented substantially vertically and directed toward an underlying surface, said support further including at least one support bracket for interconnecting said mounting bar to a wall or other substantially vertical surface, each said support bracket carrying a pair of bracket tabs at respective ends thereof for respectively interengaging and attaching to said mounting bar and the wall or other substantially vertical surface.

2. The device of claim 1 in which said mounting bar includes a pair of arms extending transversely from opposing ends of said mounting bar for interengaging and spacing said mounting bar apart from the wall or other substantially vertical surface.

3. The device of claim 2 in which each arm carries a unitary tab extending transversely from said arm for engaging the wall or other substantially vertical surface.

4. The device of claim 3 further including connectors for securing said tabs to the wall or other substantially vertical surface.

5. The device of claim 1 further including a clip carried by said mounting bar for releasably holding the tool handle.

6. A quick release storage rack assembly for holding and organizing one or more quick release tool heads above an underlying surface, each tool head including an extension post that carries a quick release spring button connector for releasably interengaging a complementary quick release tool handle connector hole of an elongate tool handle, said rack assembly comprising:

a support; and at least one tool head mounting component carried by said support above the underlying surface and including a mounting sleeve having an open lower end and an interior channel in communication with said lower end, said mounting sleeve further including at least one quick release mounting sleeve connector hole formed transversely through said mounting sleeve in communication with said interior channel; said interior channel of said mounting sleeve for receiving the extension post of a respective tool head such that said mounting sleeve depresses the spring loaded button connector carried by the extension post and the spring loaded button connector interengages said mounting sleeve connector hole to secure the tool head to said mounting sleeve, said support including a generally horizontal mounting bar and wherein said interior channel of each said mounting sleeve includes a longitudinal axis, each mounting sleeve being connected to said mounting bar such that a longitudinal axis of said interior channel of said mounting sleeve is oriented substantially vertically and directed toward the underlying surface, said support including at least one support bracket for interconnecting said mounting bar to a wall or other substantially vertical surface, each said support bracket carrying a pair of bracket tabs at respective ends thereof for respectively interengaging and attaching to said mounting bar and the wall or other substantially vertical surface.

7. The device of claim 6 in which said mounting bar includes a pair of arms extending transversely from opposing ends of said mounting bar for interengaging and spacing said mounting bar apart from a wall or other substantially vertical surface.

8. The device of claim 7 in which each arm carries a unitary tab extending transversely from said arm for engaging the wall or other substantially vertical surface.

9. The device of claim 8 further including connectors for securing said tabs to the wall or other substantially vertical surface.

10. The device of claim 6 in which said support bracket includes an angled bracket segment extending between said bracket tabs.

11. The device of claim 6 further including a clip carried by said mounting bar for releasably holding the quick release tool handle.

12. A quick release tool storage rack assembly for holding and organizing quick release tools above an underlying surface, said assembly comprising:

one or more quick release tool heads, each tool head including an extension that carries a first quick release connector;

an elongate tool handle having a complementary second quick release connector that is selectively interengaged with said first quick release connector of a respective said tool head to secure said tool head to said tool handle;

a support; and at least one tool head mounting component carried by said support above the underlying surface, each said tool head mounting component including a third quick release connector substantially equivalent to said second quick release connector of said tool handle and for being releasably interengaged by said first quick release connector of a respective said tool head to secure said respective said tool head to said mounting component; said first quick release connector including a spring loaded button connector and each of said second and third quick release connectors including a respective quick release connector hole that is selectively and releasably interengaged by said spring loaded button connector of a respective said tool head to releasably secure said tool head to a selected one of a respective said mounting component and said tool handle.

13. The assembly of claim 12 further including a clip carried by said support for releasably holding said tool handle.

* * * * *